United States Patent [19]

Lindahl

[11] Patent Number: 4,562,969

[45] Date of Patent: Jan. 7, 1986

[54] PROCESS FOR PREPARING GROUNDWOOD PULP AS SHORT FIBER AND LONG FIBER FRACTIONS

[75] Inventor: Jonas A. I. Lindahl, Domsjo, Sweden

[73] Assignee: Mooch Domsjo Aktiebolag, Ornskoldsvik, Sweden

[21] Appl. No.: 586,454

[22] Filed: Mar. 5, 1984

[51] Int. Cl.[4] ..... B02C 19/12

[52] U.S. Cl. ..... 241/21; 241/24; 241/28

[58] Field of Search ..... 241/21, 24, 28, 29, 241/261.2, 261.3, 76, 79, 80

[56] References Cited

U.S. PATENT DOCUMENTS 3,301,745 1/1967 Coppick et al. ..... 241/28 X 3,411,720 11/1968 Jones et al. ..... 241/28

*Primary Examiner*—Mark Rosenbaum

[57] ABSTRACT

A process is provided which comprises the steps of:

(1) grinding lignocellulosic material to form an aqueous groundwood pulp fiber suspension;

(2) screening the groundwood pulp fiber suspension through a coarse screen having screen openings not less that about 5 mm;

(3) defibrating lignocellulosic material separated out on the coarse screen;

(4) recycling the defibrated lignocellulosic material to the groundwood pulp fiber suspension from the grinding step (1);

(5) separating the groundwood pulp fiber suspension from step (2) into (a) an accepts fraction and (b) a rejects fraction, the latter comprising from about 30% up to about 85% by weight of the fiber suspension;

(6) screening the rejects fraction 5(*b*) of the groundwood pulp fiber suspension through a screen having screen openings of less than about 5 mm;

(7) separating the fiber suspension from step (6) into (a) an accepts fraction and (b) a rejects fraction;

(8) recycling the rejects fraction 7(*b*) to the defibrating step (3) and then to the groundwood pulp fiber suspension from the grinding step (1);

(9) screening the accepts fraction 7(*a*) to form (a) a short-fiber accepts fraction of which from about 15 to about 60% comprises fibers passing through a sieve No. 150 in a Bauer-McNett classifier; and (b) a long-fiber rejects fraction of which at least 80% comprises long fibers retained on a sieve No. 150 in a Bauer-McNett classifier;

(10) withdrawing the long-fiber rejects fraction 9(*b*) as groundwood pulp product (ii);

(11) blending the short-fiber accepts fraction 9(*a*) with accepts fraction 5(*a*); and

(12) withdrawing the resulting blend as short-fiber accepts fraction groundwood pulp product (i).

4 Claims, 2 Drawing Figures

INVENTION

PROCESS FOR PREPARING GROUNDWOOD PULP AS SHORT FIBER AND LONG FIBER FRACTIONS

Figure 1:
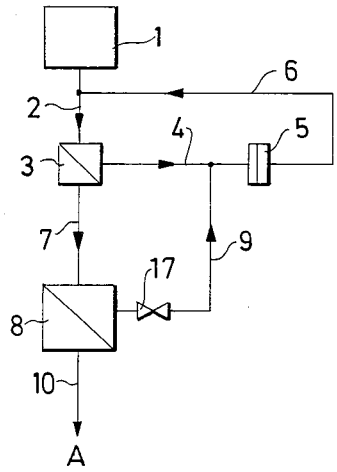
Fig. 1 PRIOR ART

Groundwood pulp is prepared by grinding lignocellulosic material such as logs or wood chips in contact with a rotating grindstone. Water is sprayed into the grinding area for cooling, and the resulting aqueous groundwood pulp fiber suspension is screened through a coarse screen to remove the coarse particles, which are then defibrated, using for example a disc refiner, and recycled to the fiber suspension from the grindstone, while the accepts fraction from the coarse screen is passed to a fine screen, where the remaining coarse particles are separated out as a rejects fraction. The rejects fraction is normally recycled to the defibration stage, while the accepts fraction containing the fiber suspension which passes through the fine screen is passed to a wet machine or paper machine, optionally after further purification in a vortex cleaner, and optionally also, after bleaching.

Groundwood pulp prepared in this way is normally used for the manufacture of newsprint and other types of printing paper, and also for the manufacture of soft crepe paper. Such papers require that the pulp have a low shives content, that is, the content of partially defibrated wood particles. In the manufacture of paper, a high shives content results in web breakages, and imparts to the paper a high degree of surface roughness, which gives rise to printing irregularities. It is therefore important to reduce the shives content in the manufacture of groundwood pulp to a low level, but this poses a serious problem, that has not yet been fully overcome.

The groundwood pulp used in the manufacture of such papers is ground to a relatively low freeness, of the order of 70 to 200 ml C.S.F.

Groundwood pulp also can be used for the manufacture of cardboard and paperboard, in which it is also desirable to have a low shives content in the pulp. Groundwood pulp used to produce cardboard should have a relatively high freeness, of the order from 250 to 400 ml C.S.F. One disadvantage with grinding to a high freeness, however, is that the pulp may have a relatively high shives content, and be relatively weak.

In recent years, a chemimechanical pulp designated "chemithermomechanical pulp", abbreviated CTMP, has been produced that has a relatively high freeness of the order of 400 to 700 ml C.S.F. and also a low shives content, and is therefore very suitable for the manufacture of absorbent paper products. It is not possible to produce groundwood pulp having a freeness above 500 ml C.S.F. in a groundwood mill, using grindstones and present day techniques. Groundwood pulp having such a high freeness has only a small percentage of fibers, and consists mainly of shives and splinters, so that it cannot be used to manufacture absorbent paper products.

These difficulties are overcome by the process of the present invention, which makes it possible to produce a groundwood pulp having a freeness of above 500 ml C.S.F., by the simple expedient of preparing the groundwood pulp in two fractions, a short-fiber fraction and a long-fiber fraction, of which the long-fiber fraction has the higher freeness. The short-fiber fraction has a negligible proportion of shives, while the long-fiber fraction has a low proportion of shives. The short-fiber fraction is further characterized by high opacity, and a freeness comparable to that of ordinary groundwood pulp.

In the process according to the invention, groundwood pulp is prepared at a low energy consumption as (i) a short-fiber fraction that is essentially shive-free and has a low freeness, low surface roughness and high opacity; and (ii) a long-fiber fraction that has a low resin content, as well as a high freeness; which comprises the steps of:

(1) grinding lignocellulosic material to form an aqueous groundwood pulp fiber suspension;

(2) screening the groundwood pulp fiber suspension through a coarse screen having screen openings not less than about 5 mm;

(3) defibrating reject lignocellulosic material separated out on the coarse screen;

(4) recycling the defibrated lignocellulosic material to the groundwood pulp fiber suspension from the grinding step (1);

(5) separating the groundwood pulp fiber suspension from step (2) into:

(a) an accepts fraction; and (b) a rejects fraction, the latter comprising from about 30% up to about 85% by weight of the fiber suspension;

(6) screening the rejects fraction 5(b) through a screen having screen openings of less than about 5 mm;

(7) separating the fiber suspension from step (6) into (a) an accepts fraction; and (b) a rejects fraction;

(8) recycling the rejects fraction 7(b) to the defibrating step (3) and then to the groundwood pulp fiber suspension from the grinding step (1);

(9) screening the accepts fraction 7(a) to form:

(a) a short-fiber accepts fraction of which from about 15 to about 60% comprises short fibers passing through a sieve No. 150 in a Bauer-McNett classifier; and (b) a long-fiber rejects fraction of which at least 80% comprises long fibers retained on a sieve No. 150 in a Bauer-McNett classifier;

(10) withdrawing the long-fiber rejects fraction 9(b) as groundwood pulp product (ii);

(11) blending the short-fiber accepts fraction 9(a) with accepts fraction 5(a); and

(12) withdrawing the resulting blend as short-fiber accepts fraction groundwood pulp product (i).

The invention further provides two novel aqueous groundwood pulp suspensions:

(a) a short-fiber groundwood pulp suspension of which from about 15 to about 60% comprises short fibers passing through a sieve No. 150 in a Bauer-McNett classifier; and having a freeness within the range from about 50 to about 200 ml C.S.F. and a shives content below about 0.05%.

(b) a long-fiber groundwood pulp suspension of which at least 80% comprises long fibers retained on a sieve No. 150 in a Bauer-McNett classifier and having a freeness within the range from about 200 to about 750 ml C.S.F. and a resin content of less than about 0.3% DKM.

The short-fiber pulp fraction because it has a low surface roughness and high opacity is suitable for producing light-weight coating papers, and also for mixing with other pulps suitable for the production of high quality printing papers.

The long-fiber pulp fraction is produced at a very low energy consumption and because it has a low resin content and a freeness within the range from about 200 to about 700 ml C.S.F. can be admixed with pulps intended for use in the preparation of absorbent paper products of high bulk, good absorption rates, and high absorptivity. The long-fiber pulp fraction also is suitable for use in pulps intended for the manufacture of cardboard or paperboard.

By the process of the invention it is possible to bring the properties of groundwood pulp in the form of short-fiber and long-fiber fractions to the high standard of chemithermomechanical pulps, while keeping manufacturing costs low, due to the low energy consumption.

Figure 2:
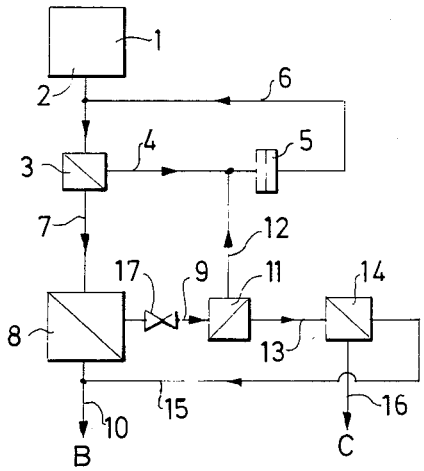

In the drawings:

FIG. 1 is a flow sheet illustrating the manufacture of groundwood pulp in accordance with the conventional groundwood pulp process; and FIG. 2 is a flow sheet showing preparation of short-fiber and long-fiber groundwood pulps in accordance with the process of the invention.

The procedure illustrated in FIG. 1 begins with the grinding of logs or wood chips in a grinder 1. The aqueous groundwood pulp fiber suspension from the grinder contains wood knots, splinters and other coarse wood residues, and is passed by way of the conduit 2 to the coarse screen 3, in the form of a bull screen, which may comprise a vibratory screen with vibrating screen plates provided with holes or slots. The bull screen has apertures exceeding 5 mm in diameter. The coarse particulate material separated as rejects from the bull screen normally is more than 50 mm long, and is passed by way of a conduit 4 to the defibrator 5, for example, a disc refiner. The defibrated material is recycled via conduit 6 to conduit 2 where it is blended with groundwood pulp suspension from the grinder 1.

The accepts fraction, the fiber suspension passing through the bull screen 3, now freed from coarse wood residues, is led by the conduit 7 to the screen room 8, which may be equipped with pressurized screens having perforated screen plates with openings about 1.75 mm in diameter.

The amount of the fiber suspension coming into the screen room 8 that is separated as rejects and is recycled is controlled by the valve 17. The valve is so set that up to about 20% by weight of the fiber suspension is separated, and sent via conduit 9 through the defibrator 5 and then via conduit 6 for blending with suspension in conduit 2. The accepts fraction from the screen room 8 is withdrawn by way of conduit 10 as the groundwood pulp product, and normally has a freeness of from 70 to 200 ml C.S.F., and a shives content of from about 0.08 to about 0.20%. The accepts fraction can be passed from conduit 10 to the wet machine, after being cleansed in a vortex cleaner (not shown).

In the process of the invention as shown in FIG. 2, logs or wood chips are ground in the grinder 1, and then passed by way of conduit 2 to the coarse screen 3, as in the conventional process illustrated in FIG. 1. The coarse wood residues separated out by the screen 3 pass via conduit 4 to a defibrator 5, for example, a disc refiner, after which the defibrated material is recycled to the suspension in conduit 2 by way of the conduit 6, as in the conventional process. The accepts fraction from the screen 3 passes by way of conduit 7 to the screen room 8, which may contain pressurized screens, as in the system of FIG. 1. However, the amount of rejects from the screen room 8 is increased, either by increasing the flow through conduit 9, by increasing the opening of the valve 17, or by reducing the diameters of the openings of the screen plates, or both, so that from about 30 to about 85% by weight of the fiber suspension arriving via conduit 7 is separated out as rejects, and passes through the conduit 9 to the separator 11. Here, residual shives and splinters having a length above 4 mm, preferably above 8 mm, are removed. This separator may comprise, for example, a vibratory screen having smaller opening diameters than the vibratory screen 3.

The suspension is separated at separator 11 into an accepts fraction and a rejects fraction. The rejects fraction passes through the conduit 12 back to the conduit 4, for recycling to the defibrator 5, after which the fraction is returned via conduit 6 to the groundwood pulp suspension from the grinder in conduit 2. The accepts fraction from the separator 11 passes via conduit 13 to a second separator 14, which may comprise for example a centrifugal screen or a curved screen, for fractionating the accepts fraction into a long-fiber fraction of which at least 80% of the fibers are retained on a sieve No. 150 in a Bauer-McNett classifier.

The long-fiber fraction from the separator 14 is withdrawn via conduit 16 at C as long-fiber groundwood pulp product, and can be dewatered and then used for special purposes.

The short-fiber accepts fraction from the separator 14 is withdrawn via conduit 15 and blended with the accepts flow from the screen room 8 in the conduit 10. The blend is withdrawn at B as short-fiber fraction groundwood pulp product.

In a particularly preferred embodiment of the invention, the white water obtained in dewatering the long-fiber fraction is recycled as dilution water to the separator 11. The white water has a fiber content below 200 mg/l, and can be obtained by incorporating a separate filter in the circuit.

Because more than the normal proportion of rejects is withdrawn at the screen room 8, the short-fiber fraction obtained in the conduit 10 as accepts fraction from the screen room 8 has an extremely low shives content, within the range from about 0 to about 0.05%, and a freeness of from about 50 to about 200 ml C.S.F. Corresponding conventional groundwood pulps of comparable freeness have a shives content of from 0.08 to 0.20%. A shives content of such a magnitude considerably impairs the usefulness of the pulp in the manufacture of printing paper, and contributes to a surface roughness of the paper which causes the paper to display a nonuniform ink absorbency.

In addition, the short-fiber pulp fraction according to the invention has a different fiber distribution than conventional groundwood pulp, and affords the advantage of a higher tensile index and a higher opacity in printing paper produced from the fraction than paper produced from conventional groundwood pulp. Consequently, it is suited for the manufacture of printing paper of the highest quality.

The long-fiber pulp fraction according to the invention has an unusually high freeness, within the range from about 200 to about 750 ml C.S.F., and a low resin content, below 0.3% DKM (after bleaching the resin content is less than 0.15% DKM). From about 80 to about 100% of the long-fiber pulp fraction comprises fibers which are retained on a sieve No. 150 in a Bauer-McNett classifier. The long fiber pulp fraction has extraordinary properties, rendering it suitable for the manufacture of absorbent products, and provides high bulk, good absorption rates and an extremely good absorption capacity. In the process according to the invention, from about 15 to about 75% of the lignocellulosic material that is ground up is recovered as long-fiber fraction.

Thus, instead of producing a single product which is inferior to chemithermomechanical pulp, the process of the invention makes it possible to obtain two groundwood pulp products, each of which has extremely good properties, which make them suitable for special purposes. These products are produced in a higher yield than conventional groundwood pulp, while using less energy. The total energy consumed when producing the long-fiber pulp fraction according to the invention is from 300 to 500 kWh/ton of dry pulp, while energy consumption in the preparation of comparable chemithermomechanical pulp is about 1,000 kWh/ton of dry pulp.

The energy consumption in manufacturing the short-fiber pulp fraction is from 1300 to 1500 kWh/ton of pulp, while about 2000 kWh/ton of dry pulp is needed to prepare chemithermomechanical pulp of corresponding quality.

When practicing the process of the invention, at least 96% of the wood is converted to groundwood pulp, as compared from 92 to 94% in the manufacture of chemithermomechanical pulp.

The long-fiber pulp fraction obtained in accordance with the invention is suited for admixture with other pulps, such as sulfite pulp, sulfate pulp and chemimechanical pulp. It is also well suited for the manufacture of cardboard and paperboard, as well as the manufacture of absorbent products. Other fiber materials such as recycled fibers, peat fibers and synthetic fibers can also be mixed with the long-fiber pulp fraction.

The process according to the invention can also be applied with good results in the manufacture of pressure-ground groundwood pulp, in which case the energy consumption is about 10% lower.

The following Example in the opinion of the inventor represents a preferred embodiment of the invention.

EXAMPLE

As a control, groundwood pulp was manufactured from spruce wood in accordance with the flow sheet shown in FIG. 1. The spruce was ground in the grinder 1, and the resultant aqueous fiber suspension (which had a pulp consistency of 2.1%) was passed through the conduit 2 to a Jonsson-type vibratory screen 3 having screen plates with 6 mm diameter openings, where the coarse wood residues were screened out. The rejects obtained in the vibratory screen 3, comprising coarse splinters and shives and constituting about 3% by weight of the groundwood fiber suspension feed, was passed through the conduit 4 at a pulp consistency of 5% to the disc refiner 5, where the coarse material was defibrated to separate fibers. The defibrated rejects fraction was passed via the conduit 6 and the conduit 2 back to the vibratory screen 3.

The accepts from the vibratory screen 3 had a pulp consistency of 1.3%, and was passed through the conduit 7 to a pressurized screen 8 having a fixed cylindrical screen basket, to the inner cylindrical surface of which the pulp suspension was passed under superatmospheric pressure. The screen was also provided with an internal rotating scraper. The openings in the perforated screen plates had a diameter of 1.75 mm.

The flow of fiber suspension to the pressurized screen 8 was so regulated that 20% by weight of the fiber content of the fiber suspension fed to the screen remained on the screen plates, and passed as rejects via the valve 17 through the conduit 9 to the conduit 4, for further defibration in the disc refiner 5, after which the material was recycled to the conduit 2. The pulp consistency in the conduit 9 was 1.9%.

Accepts from the pressurized screen 8 had a pulp consistency of 1.1% and was removed via the conduit 10, where the pulp product was further cleaned in a vortex cleaner (not shown). Samples designated A were removed, for determination of the shives content and fiber composition.

The groundwood pulp prepared in accordance with the invention, following the flow sheet shown in FIG. 2, was also prepared from spruce wood. The fiber suspension in the conduit 2 had a pulp consistency of 2.1%, and was closely screened in the vibratory screen 3 at an opening diameter of 6 mm. The rejects comprised 3% by weight of the fiber suspension feed, and was passed via the conduit 4, where the pulp consistency was 5%, to the disc refiner 5. The defibrated rejects pulp suspension had a pulp consistency of 5%, and was recycled through the conduit 6 to the conduit 2 for rescreening in the vibratory screen 3.

The accepts from the vibratory screen 3 had a pulp consistency of 1.3%, and was passed via conduit 7 to the pressurized screen 8. The screen plates were changed to an opening diameter of 1.60 mm instead of 1.75 mm. At the same time, the valve 17 was opened further, so that the amount of rejects passing through the valve rose to 70% by weight of the fiber content of the fiber suspension feed. The rejects pulp fraction obtained in the pressurized screen 8 had a freeness of 245 ml C.S.F.; a shives content of 2.95% according to Sommerville; 33.1% of the fibers was retained on a sieve No. 20 and 41.5% on a sieve No. 150 in a Bauer-McNett classifier, and 25.4% passed through the sieve No. 150.

The rejects was brought to a pulp consistency of 1.5%, and passed via conduit 9 to the separator 11, which was in the form of a vibratory screen provided with screen plates having an opening diameter of 3.0 mm. The vibratory screen was so adjusted that the amount of rejects was 0.8% by weight of the fiber suspension feed. The rejects from the vibratory screen separator 11 had a shives content of 73% according to Sommerville, and passed via conduit 12 to the conduit 4, for further defibration in the disc refiner 5, after which it was returned via conduit 6 to the conduit 2.

The pulp consistency in the conduits 6 and 2 was the same as that in the control.

The accepts pulp fraction from the vibratory screen separator 11 was brought to a pulp consistency 1.2%, and passed through the conduit 13 to a second separator 14, where the pulp was fractionated into two fractions, one having long fibers and one having short fibers. The fractionator was a Cowan type centrifugal screen having a stationary cylindrical screen basket, against the inner cylindrical surface of which the fiber suspension was slung by a rotating device. As distinct from vibratory screens, centrifugal screens are so constructed as to utilize the mutual autogenous effect of the fibers at the screen surfaces, and have larger opening diameters. The centrifugal screen separator 14 had an opening diameter of 1.50 mm.

20% of the fiber suspension leaving the vibratory screen separator 11 through the conduit 13 was removed as accepts in the centrifugal screen separator 14.

This accepts fraction had a freeness of 140 ml C.S.F., and a shives content of 0.04% according to Sommerville. 3.1% of the accepts fraction was retained on a sieve No. 20 and 82% on a sieve No. 150 in a Bauer-McNett classifier, and 14% passed through the sieve No. 150.

This accepts fraction was given a pulp consistency of 0.9%, and was passed by the conduit 15 to conduit 10, and blended with the accepts flow from the pressurized screen 8. This accepts flow had a freeness of 90 ml C.S.F., a shives content of 0.01%, according to Sommerville, and a fiber distribution such that 2.3% was retained on a sieve No. 20 and 63.7% on a sieve No. 150 in a Bauer-McNett classifier, and 34% passed through the sieve No. 150.

The mixed accepts from the pressurized screen 8 and the centrifugal screen separator 14, the short-fiber fraction, was withdrawn through the conduit 10 as short fiber groundwood pulp product B, and further cleaned in a vortex cleaner (not shown in the FIGURE).

The amount of short fiber product withdrawn as B, calculated on the basis of the wood material feed, was 44%, of which 31.2% was fed via conduit 15.

The rejects fraction from the centrifugal screen separator 14 comprised 80% of the fiber suspension leaving the vibratory screen separator 11 through the conduit 13, and was brought to a pulp consistency of 1.9%, and then removed as long-fiber groundwood pulp C through the conduit 16.

The ratio of short fiber pulp product B to long fiber pulp product C was 1 to 2.2.

Samples of pulp A, short-fiber pulp B and long-fiber pulp C were taken, for determining freeness, shives content and fiber distribution.

Table I sets forth the freeness, shives content and fiber distribution of the Control, sample A, the short fiber pulp B, the long fiber pulp C, and a typical chemithermomechanical pulp as D.

TABLE I

| Sample | Freeness C.S.F., ml | Shive Content according to Sommerville % | Fiber Distribution (Bauer McNett) % retained on sieve No. 20 | on sieve No. 150 | passing through sieve No. 150 |
|---|---|---|---|---|---|
| A | 120 | 0.06 | 8.5 | 58.4 | 33.1 |
| B | 115 | 0.03 | 2.7 | 62.3 | 35.0 |
| C | 622 | 0.40 | 48.1 | 45.2 | 6.7 |
| D | 600 | 0.35 | 35.2 | 46.1 | 18.9 |

The Table shows that the short fiber pulp B in accordance with the invention has a very low shives content. The long fiber pulp C in accordance with the invention has a very high freeness, a low shives content, and a very high content of long fibers.

Some of the samples taken were bleached, using 3% hydrogen peroxide calculated per ton of dry pulp, and were then washed, dewatered and dried to form laboratory sheets, which were analyzed with respect to resin content and brightness. Part of the laboratory sheets were disintegrated in a disc refiner to form fluff pulp, of which the bulk, absorption rate, and absorption capacity were determined. The data are set forth in Table II below, with sulfite pulp added for comparison as sample E.

TABLE II

| Sample | Resin Extractives Content DKM % | Brightness ISO % | Bulk $cm^3/g$ | Absorption Time seconds | Absorption Capacity g $H_2O$/g pulp |
|---|---|---|---|---|---|
| A | 0.95 | 80.0 | 12.5 | 4.6 | 9.9 |
| C | 0.08 | 78.2 | 17.7 | 6.0 | 10.7 |
| D | 0.19 | 74.6 | 17.9 | 7.3 | 10.9 |
| E | 0.32 | 92.5 | 16.2 | 5.0 | 9.2 |

The data in Table II shows that the long fiber pulp sample C in accordance with the invention had a very high bulk and absorption capacity, equal to the high yield chemithermomechanical pulp, considered best up to now for the manufacture of absorbent products. The properties of the long fiber pulp C also are markedly better than those of the sulfite pulp. The long fiber fraction C had a lower resin content, and at the same time a higher brightness than the chemithermomechanical pulp. This high brightness is surprising, since the pulp has a low light-scattering coefficient (see Table III, below).

Papers were produced from samples A and B, and the properties of the papers determined. The results are set forth in Table III.

TABLE III

| Sample | Tensile Index Nm/g | Tear Index mN · $m^2$/g | Light-scattering coefficient $m^2$/kg | Opacity % |
|---|---|---|---|---|
| A | 31.8 | 3.7 | 59.5 | 92.5 |
| B | 34.2 | 3.3 | 63.5 | 95.6 |

The short fiber pulp B in accordance with the invention had a higher tensile index and a considerably higher opacity than the conventional groundwood pulp of sample A.

Accordingly, the method according to the invention makes it possible to produce improved groundwood pulp products as short-fiber and long-fiber fractions for widely varied uses, such as finer pulps for the manufacture of printing papers of high quality, and coarser pulps for the manufacture of fluff and cardboard, while consuming less energy than required in the manufacture of conventional groundwood pulps.

Having regard to the foregoing disclosure the following is claimed as the inventive and patentable embodiments thereof:

1. A process for preparing groundwood pulp at a low energy consumption as (i) a short-fiber fraction that is essentially shive-free and has a low freeness, low surface roughness and high opacity; and (ii) a long-fiber fraction that has a low resin content, as well as a high freeness; which comprises the steps of:

(1) grinding lignocellulosic material to form an aqueous groundwood pulp fiber suspension;

(2) screening the groundwood pulp fiber suspension through a coarse screen having screen openings not less than about 5 mm;

(3) defibrating reject lignocellulosic material separated out on the coarse screen;

(4) recycling the defibrated lignocellulosic material to the groundwood pulp fiber suspension from the grinding step (1);

(5) separating the groundwood pulp fiber suspension from step (2) into (a) an accepts fraction and
(b) a rejects fraction, the latter comprising from about 30% up to about 85% by weight of the fiber suspension;

(6) screening the rejects fraction 5(b) through a screen, having screen openings of less than about 5 mm;

(7) separating the fiber suspension from step (6) into
(a) an accepts fraction and
(b) a rejects fraction;

(8) recycling the rejects fraction 7(b) to the defibrating step (3) and then to the groundwood pulp fiber suspension from the grinding step (1);

(9) screening the accepts fraction 7(a) to form
(a) a short-fiber accepts fraction of which from about 15 to about 60% comprises fibers passing through a sieve No. 150 in a Bauer-McNett classifier; and
(b) a long-fiber rejects fraction of which at least 80% comprises long fibers retained on a sieve No. 150 in a Bauer-McNett classifier;

(10) withdrawing the long-fiber rejects fraction 9(b) as groundwood pulp product (ii);

(11) blending the short-fiber accepts fraction 9(a) with accepts fraction 5(a); and

(12) withdrawing the resulting blend as short-fiber accepts fraction groundwood pulp product (i).

2. A process according to claim 1, which comprises controlling the proportions separated as accepts fraction and rejects fraction in steps (5), (7) and (9) and the proportions blended in step (11) so that the weight ratio of the long-fiber fraction to the short-fiber fraction is within the range from 1:3 to 3:1.

3. A process according to claim 2 in which an amount within the range from about 15 to about 75% of the lignocellulosic material ground in step (1) is taken out as a long-fiber pulp product (ii).

4. A process according to claim 3 in which the screening steps (2), (6) and (9) and the defibrating step (3) are carried out in a manner such that the shives content of the short-fiber pulp product (i) is less than 0.05% by weight.

* * * * *